United States Patent [19]

Lamm et al.

[11] Patent Number: 4,472,609

[45] Date of Patent: Sep. 18, 1984

[54] MULTIPLE FLAT-TYPE SWITCH

[75] Inventors: Klaus D. Lamm; Dieter Michalski, both of Berlin, Fed. Rep. of Germany

[73] Assignee: ITT Industries, Inc., New York, N.Y.

[21] Appl. No.: 425,300

[22] Filed: Sep. 28, 1982

[30] Foreign Application Priority Data

Oct. 14, 1982 [DE] Fed. Rep. of Germany ..... 3140771

[51] Int. Cl.[3] ..... H01H 13/70

[52] U.S. Cl. ..... 200/5 A; 200/159 B; 200/292; 361/398

[58] Field of Search ..... 200/5 A, 5 R, 86 R, 200/159 B, 275, 1 R, DIG. 1, DIG. 2; 361/398

[56] References Cited

U.S. PATENT DOCUMENTS

| | | | |
|---|---|---|---|
| 3,383,487 | 5/1968 | Wiener | 335/2 X |
| 3,721,926 | 3/1973 | Berenbaum et al. | 200/5 A X |
| 3,742,157 | 6/1973 | Leposavic | 200/159 B |
| 4,127,740 | 11/1978 | LaMarche | 200/5 A X |
| 4,143,253 | 3/1979 | Wagner et al. | 200/5 A |
| 4,156,802 | 5/1979 | Gilano et al. | 200/5 A |
| 4,158,115 | 6/1979 | Parkinson et al. | 200/5 A |
| 4,249,044 | 2/1981 | Larson | 200/5 A |
| 4,272,657 | 6/1981 | Iijima | 200/5 A |
| 4,303,811 | 12/1981 | Parkinson | 200/5 A |
| 4,349,712 | 9/1982 | Michalski | 200/5 A X |
| 4,362,911 | 12/1982 | Sears et al. | 200/5 A |

*Primary Examiner*—J. R. Scott

*Attorney, Agent, or Firm*—James B. Raden; William J. Michals

[57] ABSTRACT

A multiple flat-type switch consisting of three foils of insulating material placed on top of each other and bonded to one another. The center foil is provided with holes and the two outer foils are provided on their insides with contact surfaces which come into contact with one another when a pressure is exerted upon the foil arrangement. For the purpose of achieving a switch having a large overtravel (overlift) the contact surfaces are arranged in one row along the edge of the foil arrangement, while the leads extend almost vertically in relation to the edge of the foil. The foil arrangement is slotted from the edge within the area of the contact surfaces, and arranged on a foam-plastic base. For preventing the metallizations from being damaged, metal-free regions are provided for at the points of pressure attack, and the contact surfaces of the upper foil are connected in a spiral-shaped manner to their respective terminals within the area of the holes of the center foil.

2 Claims, 6 Drawing Figures

Fig.4
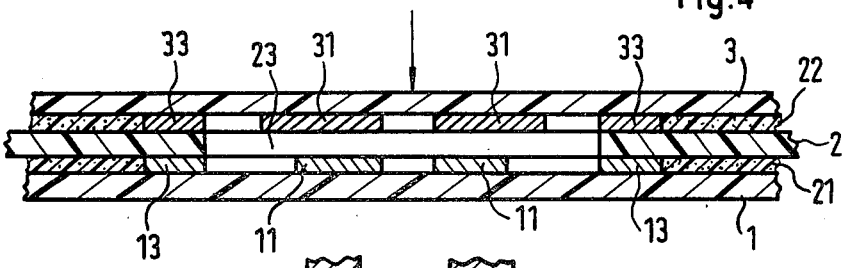
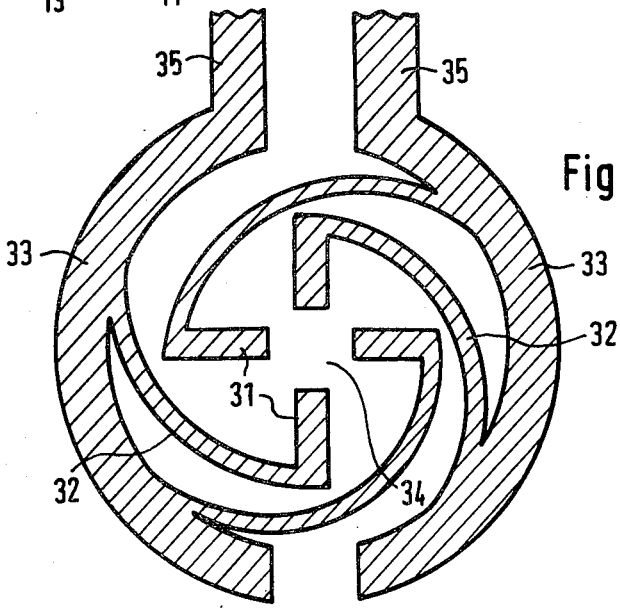
Fig.5
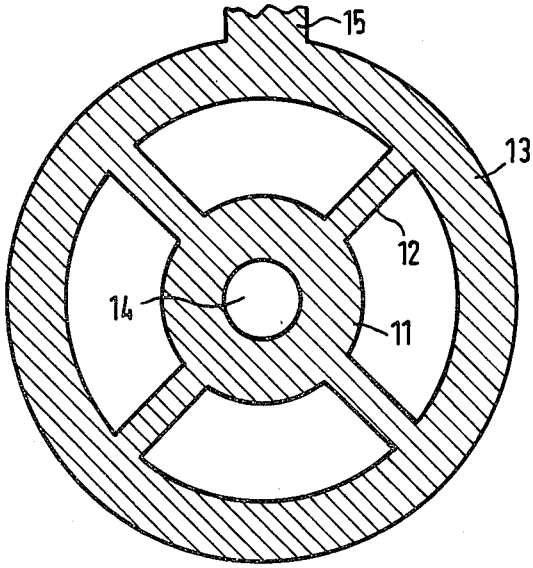
Fig.6

MULTIPLE FLAT-TYPE SWITCH

BACKGROUND OF THE INVENTION

The invention relates to a multiple flat-type switch consisting of foils of insulating material bonded to one another and having metallized contact surfaces and terminals, in which on the top side of a lower foil of insulating material, several contact areas with terminals are arranged, on which a central foil of insulating material is disposed which, within the area of the contact surfaces, is perforated, with a top foil of insulating material being arranged thereon which, on its bottom side and within the area of the holes, is provided with contact surfaces, as well as with terminals connected to the contact surfaces.

Multiple flat-type switches of the kind mentioned hereinbefore, are known, for example, from DE-OS No. 29 02 769, DE-OS No. 29 03 898 and DE-AS No. 26 60 067.

Such flat-type switches are frequently used with electronic equipment, such as with the keyboards of electric pocket calculators.

Conventional multiple flat-type switches, however, are unsuitable for certain practical applications in which the individual switches are required to have a large overtravel (overlift). By this it is understood that after a certain actuating path, the electric contacts are closed, but that subsequently thereto a further depression of the actuators must be possible, for example, that the entire actuating path for the switch must be long.

The path which the actuator is still capable of travelling after the closing of the contacts, is referred to as the overtravel. Such an overtravel, for example, is required in the case of switches which are intended to be triggered by the manual keys of a musical instrument. Conventional multiple flat-type switches, however, are unsuitable for effecting such an overtravel.

It is the object of the invention to provide a multiple flat-type switch of the kind referred to hereinbefore, in which the individual switches have a large overtravel.

SUMMARY OF THE INVENTION

In the multiple flat-type switch according to the invention, the individual contact surfaces are arranged in one row along the edge of the foil arrangement, and the associated terminals extend substantially vertically in relation to the edge of the foil arrangement. Between the contact surfaces, the foil arrangement is slotted, so that the thus obtained foil strips with each time one contact arrangement are movable with respect to one another or with respect to the entire foil arrangement. Moreover, the foil arrangement, at least with its slotted area, is arranged on a foamed-plastics base so that it, on the one hand, in the normal state, assumes a defined position and that, during actuation, owing to the pressing into the foamed-plastics material, there is achieved a large overtravel of the individual switches. The slots between the individual contact arrangements in the foil arrangement are necessary, because otherwise, owing to the foamed-plastics base, upon actuation of a switch, the entire foil arrangement would be deformed thus also causing the adjoining switches to be brought out of their normal (initial) positions.

The use of a foamed-plastics base for achieving a large travel of the contacts of electric switches is known per se from DE-OS No. 28 12 006.

The use of such a foamed-plastics base for achieving a large travel in the case of multiple flat-type switches of the conventional kind, however, is not possible for the reasons outlined above, and relative thereto, it is still to be considered that the individual switches of the conventional flat-type switches are mostly arranged in coordinate form.

Only by arranging the switches along the edge of the foil arrangement with terminals extending substantially vertically in relation to the edge, and by providing slots between the individual switches, it is made possible, by providing a foamed-plastics base, to achieve a large overtravel in the case of such flat-type switches.

Multiple flat-type switches according to the invention are particularly suitable for use as key contacts in the keybroads or manuals of electric or electronic musical instruments.

The invention as well as advantageous further embodiments thereof will now be explained in greater detail with reference to FIGS. 1 to 6 of the accompanying drawings, in which:

BRIEF DESCRIPTION OF THE DRAWING

FIG. 2 shows the arrangement in the non-actuated state, and FIG. 3 shows the arrangement in the actuated state, FIG. 4 is the sectional view of the foil arrangement of the multiple flat-type switch according to the invention, and FIGS. 5 and 6 show the metallizing pattern for the foils of the switch according to FIG. 4, in a top view.

DETAILED DESCRIPTION

Figure 1:
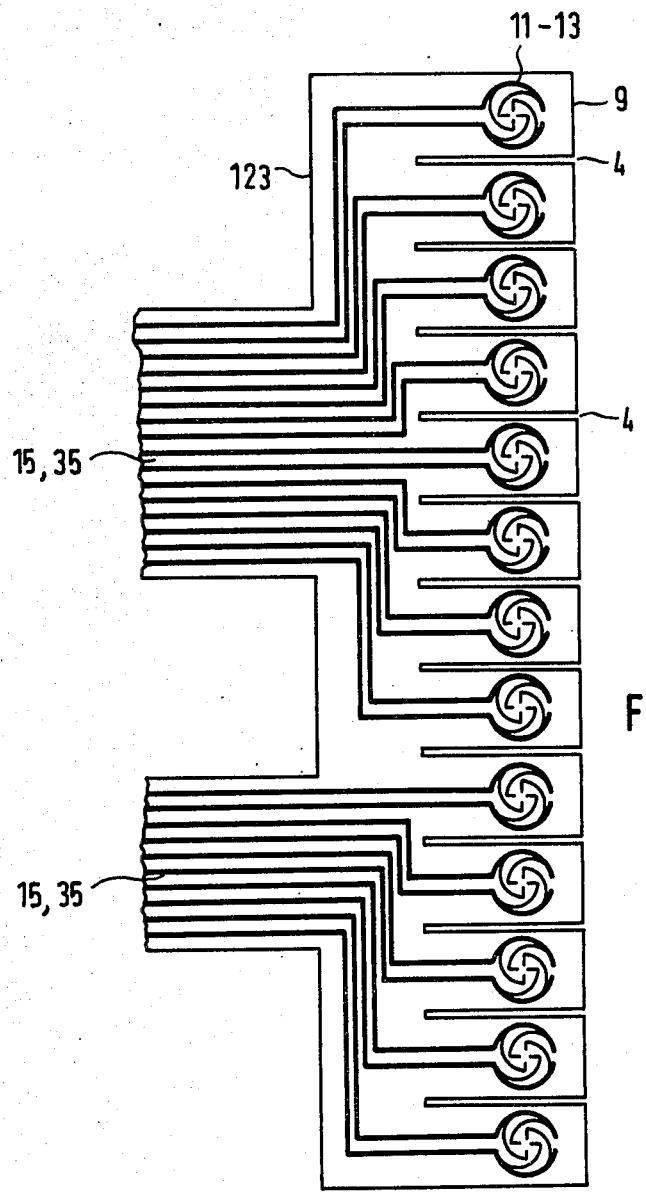
FIG. 1 is the top view of a multiple flat-type switch according to the invention.

The multiple flat-type switch according to the invention, as is shown in a top view in FIG. 1, consists in the manner known per se, of three foils of insulating material bonded to one another, of which the lower one and the upper one are provided with metallizations (metal coatings) which partly form the switch contacts and partly the leads and terminals therefor. In the foil arrangement 123 the metallizations of both the lower foil and the upper foil face one another and, in the individual switch units, oppose each other. Between the lower and the upper foil of insulating material there is arranged a non-metallized foil of insulating material which, within the area of the individual switch contacts, is provided with recesses or holes. By exerting a pressure upon the upper foil of insulating material, this foil is arched to such an extent that the corresponding contact surfaces will come in touch with those on the lower foil of insulating material, thus establishing the electrical contact of the switch. For this purpose, the foil arrangement must be disposed on a solid base. In the case of a flexible base, the foil arrangement would be arched altogether, with this not only causing the adjacent switches to be brought out of their initial position, but in some cases, the rigidity of the foil arrangement as a whole, would prevent the upper foil from being pressed down completely to the point of contact-making.

In the multiple flat-type switch according to the invention, the individual contact surfaces 11 to 13 are arranged in one row along the edge 9 of the foil arrangement 123. The metallized strips forming the leads and the terminals 15, 35 for the contact surfaces, following the contact surfaces, are arranged to extend substantially vertically in relation to the edge 9 of the foil arrangement 123. This foil arrangement is slotted from the edge 9 so that the individual switches are movable with respect to one another and with respect to the foil arrangement 123. In FIG. 1, the slots are indicated by the reference numeral 4.

Only with the aid of these measures it has become possible to arrange the multiple flat-type switch on a foamed plastics base for achieving a large overtravel (overlift).

Figure 2:
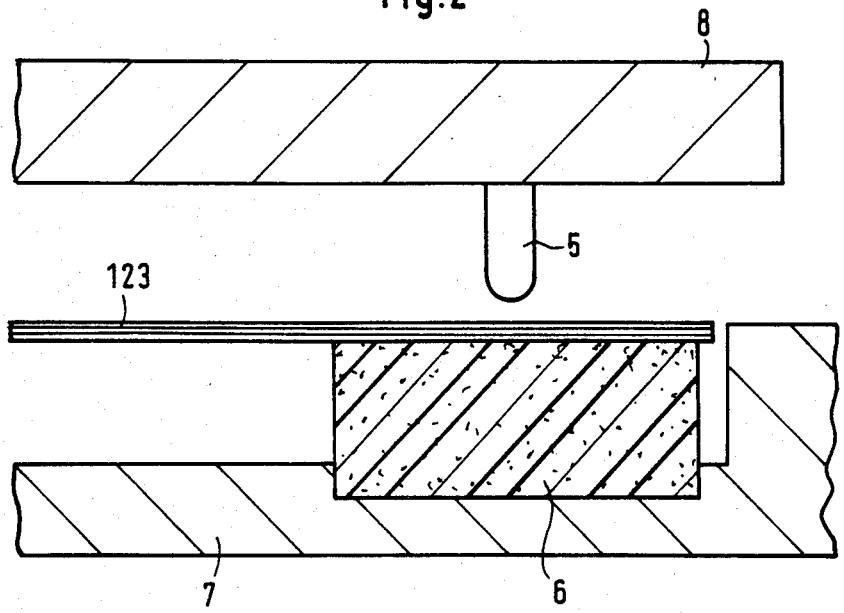
FIGS. 2 and 3 show the arrangement of a multiple flat-type switch according to the invention in the key manual of a musical instrument, in a sectional view.
Figure 3:
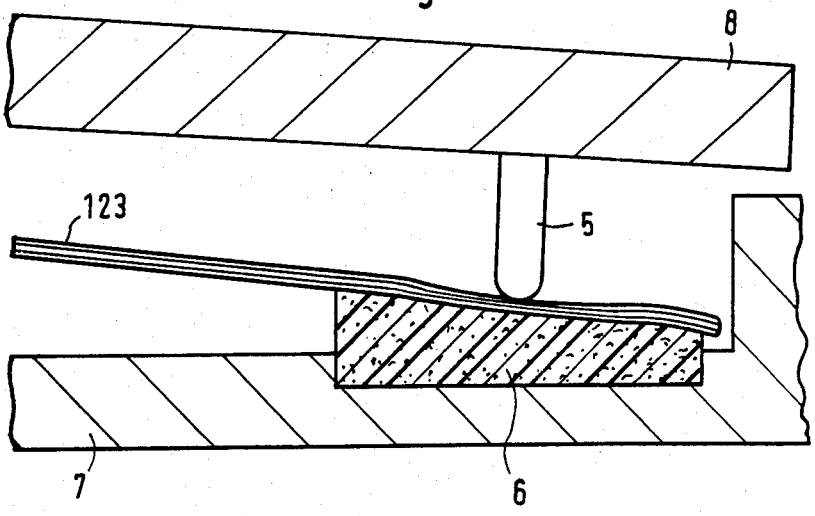

From the sectional view of FIGS. 2 and 3 it can be seen how a multiple flat-type switch according to the invention is arranged in a manual (keyboard).

In FIG. 2 the arrangement is shown in the non-actuated, and in FIG. 3 in the actuated state. In this case, the foil arrangement 123, at least within the area of the slots, is disposed on a foamed-plastics base 6. This foamed-plastics base, for example, is applied to the bottom 7 of the manual. Above the foil arrangement 123 there is disposed a manual key 8 which, on its bottom side, is provided with an actuating pin 5. This actuating pin assumes a quite defined position in relation to the individual switch contacts which will still be explained in greater detail hereinafter with reference to FIGS. 4 to 6. Upon actuating the manual key 8, the actuating pin 5, as can be seen from FIG. 3, presses on one of the strips containing the contact surfaces, thus depressing the upper foil to such an extent that its contact surface will come in touch with the contact surface on the lower foil. Owing to the foamed-plastics base 6, however, the manual key 8 can thereafter still be moved quite a bit further in the downward direction, in the course of which the foamed-plastics base 6 is compressed. Owing to the slots between the individual contact arrangements, however, the other contacts lying next to the actuated contact arrangement, are not affected. As soon as the pressure exerted upon the key 8 is released, the expanding foamed plastics 6 returns the tongue of the foil arrangement 123 to its original position.

FIG. 4 is a partly sectional view taken through a multiple flat-type switch according to the invention, while FIGS. 5 and 6 show top views onto the associated contact surface arrangements.

The multiple flat-type switch, as is shown in FIG. 4, consists of the foil 1 provided with metal surfaces, of the foil 2 provided with holes, and of the foil 3 likewise provided with metal surfaces which are all bonded to one another, for example, by means of an adhesive. For manufacturing such a flat-type switch arrangement, the non-metallized foil 2 is appropriately to be provided on both sides with adhesive layers 21 and 22. The metal surfaces which are provided with the foils 1 and 3 then only need to be placed on both sides of the foil 2, and pressed on. Within the area of the contact surfaces, the foil 2 is provided with holes 23.

The electrical contact between the contact surfaces of the foils 1 and 3 is established in that a pressure is exerted upon the foil 3, as is indicated by the arrow in FIG. 4. It has proved that the foil 3, but also the foil 1, is subjected to a particular mechanical strain at this point. Therefore, it is very advantageous to keep the foils free from metal coatings at this point. The contact arrangement on the upper foil 3, as shown in the top view of FIG. 5, as well as the contact arrangement on the lower foil 1, as shown in FIG. 6, therefore, are provided with metal-free regions 34 or 14 respectively at the central point mostly stressed by the pressure.

Moreover, it has proved very advantageous for achieving a good and uniform support of the foils 3 and 1, to provide at the edge of the hole 23 in the foil 2, i.e., on the foils 1 and 3, annularly arranged metal coatings at the edge of the hole. This annular metallization on the top foil 3 is indicated in FIG. 5 by the reference numeral 33, and the annular metallization on the lower foil 1 is indicated in FIG. 6 by the reference numeral 13. As can be seen from FIG. 4, these two metallizations 13 and 33 are lying on top of each other at the edge of the hole 23 in the foil 2. Of course, as is shown in FIG. 5, this ring may be interrupted in cases where the contacts are to be connected to two different terminals 35. Thus, in the contact arrangement according to FIG. 5, each time two contact surfaces 31 are each connected to one partial ring 33.

Also in the contact arrangement as shown in FIG. 6, which is positioned on the lower foil 1, the contact surface 11 which, in this case is of annular design, may be subdivided into two or more parts so that then also the ring 13 must be subdivided accordingly, with each partial ring then being provided with a separate terminal 15.

It has proved advantageous to design the contact surfaces 31 as arranged on the top foil 3, to have the shape of strips arranged in a cross-shaped manner. If, in that case, two contacts are to be closed by the switch, appropriately two oppositely arranged contact strips 31 are connected to different terminals 35. The ring 11 in the contact surface shown in FIG. 6, may serve as a bridge contact for the four contact surfaces 31 as shown in FIG. 5, but may also be provided with one additional terminal as is shown in FIG. 6 at point 15.

Moreover, it has proved that the electric leads which are required to extend from the contact surfaces 31 according to FIG. 5 to the ring 33, are mechanically very strongly stressed by the bending through of the foil 3 during the switching operation. In order to prevent these leads from being interrupted owing to the bending through (arching) of the foil 3, these leads 32 are not arranged radially but in a large as possible angle in relation to the radii extending from the center point of the metal-free surface 34. It is of particular advantage to arrange these leads 32 in a spiral-shaped manner as is shown in FIG. 5. This substantially reduces the danger of an interruption likely to be caused by the expansion of the foil 3 during actuation.

Multiple switches according to the invention are particularly suitable for the use as key contacts for electric musical instruments.

We claim:

1. A multiple flat-type foil switch comprising, in combination:

first and second substantially parallel layers of insulating material;

a third layer of insulating material provided between said first and second layers and said third layer having predetermined openings therein;

a first member of conductive contact material between said first and third layers of insulating material;

a second member of conductive contact material provided between said third and second layers of insulating material;

wherein said first member comprises a plurality of switch contacts bonded to said first layer along an edge portion of said first layer and respectively overlying said openings;

wherein said second member comprises a plurality of switch contacts bonded to said second layer along the edge portion thereof corresponding to said edge portion of said first layer and respectively overlying said openings; and, wherein said layers transversely slotted between said openings with each slot extending substantially inward from the edge portion isolating individual opposing pairs of said contacts whereby said opposing pairs of said contacts are movable into engagement with one another, and are movable independently of and relative to adjacent ones of said opposing pairs of said contacts.

2. The foil switch according to claim 1, including a base of foam plastic engaging one of said first and second layers and resiliently supporting said foil switch.

* * * * *